US010575638B2

(12) United States Patent
Wantland et al.

(10) Patent No.: US 10,575,638 B2
(45) Date of Patent: Mar. 3, 2020

(54) DRAWER ASSEMBLY WITH EXPANDABLE BINS FOR AN APPLIANCE

(71) Applicant: Haier US Appliance Solutions, Inc., Wilmington, DE (US)

(72) Inventors: Louis A. Wantland, Louisville, KY (US); Bagawathkumar Chellappan, Prospect, KY (US); Santosh Kumar, Siliguri (IN); Veeresh P., Bhadravathi (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 15/992,269

(22) Filed: May 30, 2018

(65) Prior Publication Data

US 2019/0365099 A1 Dec. 5, 2019

(51) Int. Cl.

| | |
|---|---|
| ***F25D 25/02*** | (2006.01) |
| ***A47B 88/48*** | (2017.01) |
| ***A47B 88/453*** | (2017.01) |
| ***A47B 88/40*** | (2017.01) |

(52) U.S. Cl.

CPC ..... *A47B 88/48* (2017.01); *A47B 88/402* (2017.01); *A47B 88/453* (2017.01); *F25D 25/025* (2013.01); *F25D 25/027* (2013.01); *A47B 2210/175* (2013.01)

(58) Field of Classification Search

CPC ... F25D 25/027; F25D 25/025; A47B 88/453; A47B 88/48; A47B 88/402

See application file for complete search history.

(56) References Cited

U.S. PATENT DOCUMENTS

| | | | | |
|---|---|---|---|---|
| 4,729,613 | A | 3/1988 | Tromble et al. | |
| 9,074,810 | B2 | 7/2015 | Hwang et al. | |
| 2008/0265727 | A1* | 10/2008 | Kohlman | A47B 67/02 312/319.1 |
| 2011/0187250 | A1* | 8/2011 | Larson | A47B 3/0912 312/322 |
| 2012/0181910 | A1 | 7/2012 | Kim | |
| 2013/0257253 | A1 | 10/2013 | Haltmeyer et al. | |

(Continued)

FOREIGN PATENT DOCUMENTS

| | | | |
|---|---|---|---|
| GB | 680407 | A | 10/1952 |
| KR | 101501937 | B1 | 3/2015 |

*Primary Examiner* — Kimberley S Wright

(74) *Attorney, Agent, or Firm* — Dority & Manning, P.A.

(57) ABSTRACT

An appliance having a drawer assembly that has features that facilitate organization and user access to the contents of the drawer assembly is provided. In some exemplary embodiments, the appliance, such as a refrigerator appliance, includes a drawer movable between a retracted position and a withdrawn position. A bin is rotatably coupled with the drawer between a received position and an expanded position. When the drawer is moved outward from a chamber defined by the appliance to the withdrawn position, the features of the drawer assembly automatically rotate the bin from the received position to the expanded position such that the contents within the bin are readily accessible. When the drawer is moved the retracted position, the features of the drawer assembly automatically rotate the bin to the received position so that drawer assembly may be retracted within the chamber of the appliance.

20 Claims, 13 Drawing Sheets

(56) References Cited

U.S. PATENT DOCUMENTS

| | | | | |
|---|---|---|---|---|
| 2013/0257254 | A1* | 10/2013 | Austin | F25D 25/025 312/404 |
| 2014/0001943 | A1 | 1/2014 | Kim et al. | |
| 2016/0265816 | A1 | 9/2016 | Gillette et al. | |
| 2018/0335249 | A1* | 11/2018 | Pathapati | F25D 23/04 |

* cited by examiner

DRAWER ASSEMBLY WITH EXPANDABLE BINS FOR AN APPLIANCE

FIELD OF THE INVENTION

The present subject matter relates generally to appliances, such as refrigerator appliances, and drawer assemblies for the same.

BACKGROUND OF THE INVENTION

Generally, refrigerator appliances include a cabinet that defines a chilled chamber for receipt of food items for storage. The refrigerator appliance can also include storage components mounted within the chilled chamber. For example, shelves, drawers, bins, and other components can be mounted within the chilled chamber. Such components can receive food items in order to facilitate storage and/or organization of food items within the chilled chamber. For instance, certain refrigerator appliances include fresh food drawers that are configured for extending the shelf life of fresh food (e.g., vegetables, cheeses, etc.) stored therein.

Many consumers store smaller food items, e.g., soda cans, condiments, butter, and the like, within the bins and shelves of the refrigerator doors. Such door bins and shelves are typically smaller than other storage components of a refrigerator appliance and thus are better equipped to store smaller food items. Many times, however, door bin and shelf storage space is limited. Aside from door storage components, many conventional refrigerators lack storage components that are equipped for storing smaller food items. Thus, consumers are forced to store smaller items on or within large storage components, which may be an inefficient use of space. Further, accessing smaller items from refrigerator appliance may be challenging. For instance, items stored on door storage components may be challenging to access as the door may swing about its hinge axis as a user attempts to access food items or place them on the shelves. In addition, when smaller food items are stored within larger components, a consumer is typically required to reach all the way into the chilled chamber and the consumer may potentially need to move other food items to access or store smaller food items.

Accordingly, a refrigerator appliance having features that address one or more of the challenges noted above would be useful.

BRIEF DESCRIPTION OF THE INVENTION

Aspects and advantages of the invention will be set forth in part in the following description, or may be apparent from the description, or may be learned through practice of the invention.

In a first exemplary embodiment, an appliance is provided. The appliance includes a cabinet defining a chamber. The appliance also includes a drawer assembly configured to slide between a retracted position and a withdrawn position. The drawer assembly includes a drawer slidably received within the chamber in the retracted position and at least partially withdrawn from the chamber in the withdrawn position. Further, the drawer assembly includes a bin rotatably coupled with the drawer about a rotation axis between a received position and an expanded position, wherein when the bin is in the received position, the bin is received within the drawer and wherein when the bin is in the expanded position, the bin is rotated outward from the drawer about the rotation axis. When the drawer assembly is in the withdrawn position, the bin is rotated to the expanded position and wherein when the drawer assembly is in the retracted position, the bin is received within drawer in the received position.

In a second exemplary embodiment, a refrigerator appliance is provided. The refrigerator appliance includes a cabinet defining a chilled chamber. The refrigerator appliance also includes a drawer assembly movable between a retracted position and a withdrawn position. The drawer assembly includes a frame coupled with the cabinet. The drawer assembly also includes a drawer movably coupled with the frame and configured to be received within the chilled chamber in the retracted position and at least partially withdrawn from the chilled chamber in the withdrawn position. The drawer assembly further includes a bin rotatably coupled with the drawer about a rotation axis and movable between a received position and an expanded position, wherein when the bin is in the received position, the bin is received within the drawer and wherein when the bin is in the expanded position, the bin is rotated about the rotation axis. Moreover, when the drawer assembly is moved toward the withdrawn position, the bin is automatically rotated toward the expanded position and wherein when the drawer assembly is moved toward the retracted position, the bin is automatically rotated toward the received position.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
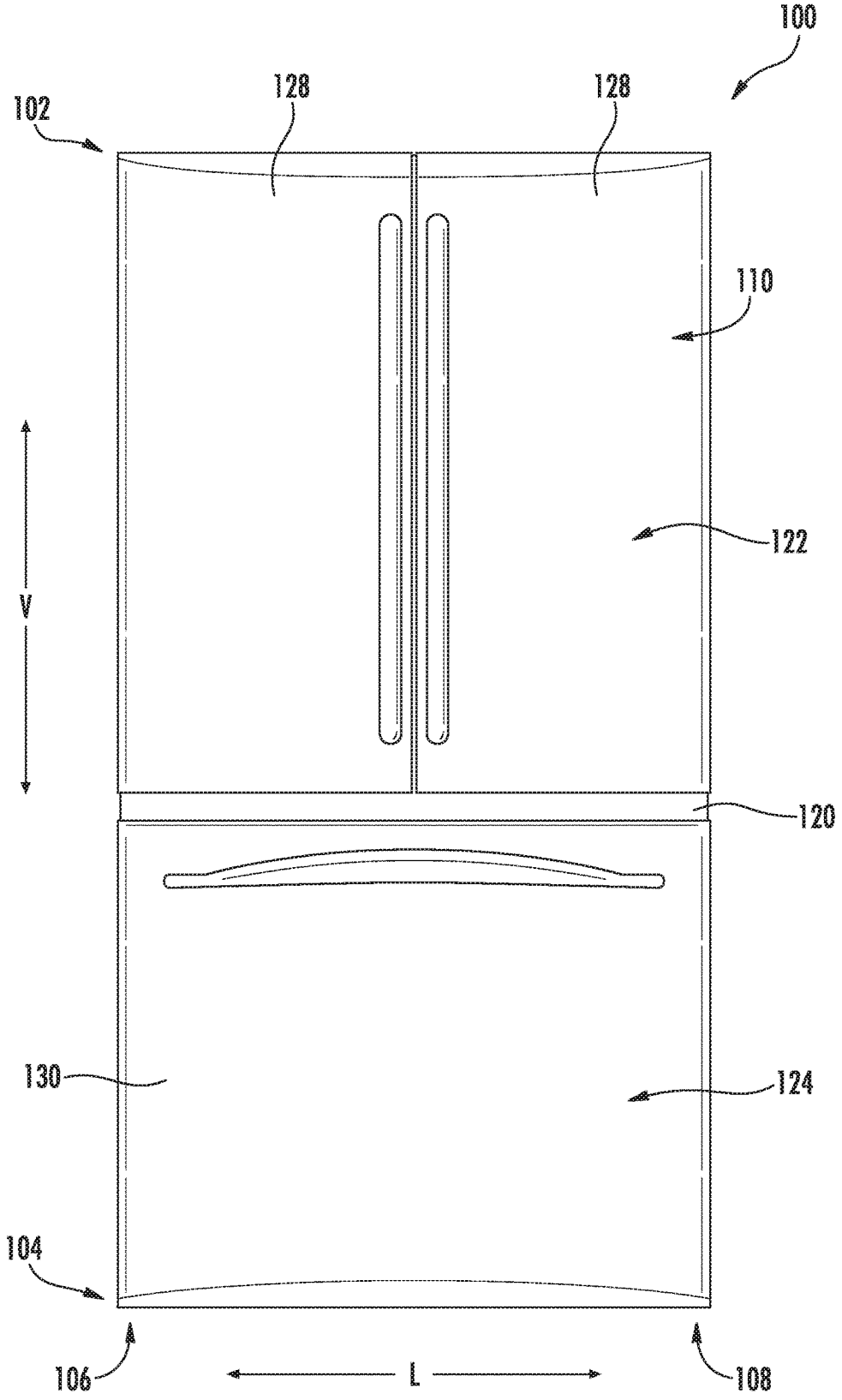
FIG. 1 provides a front, elevation view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
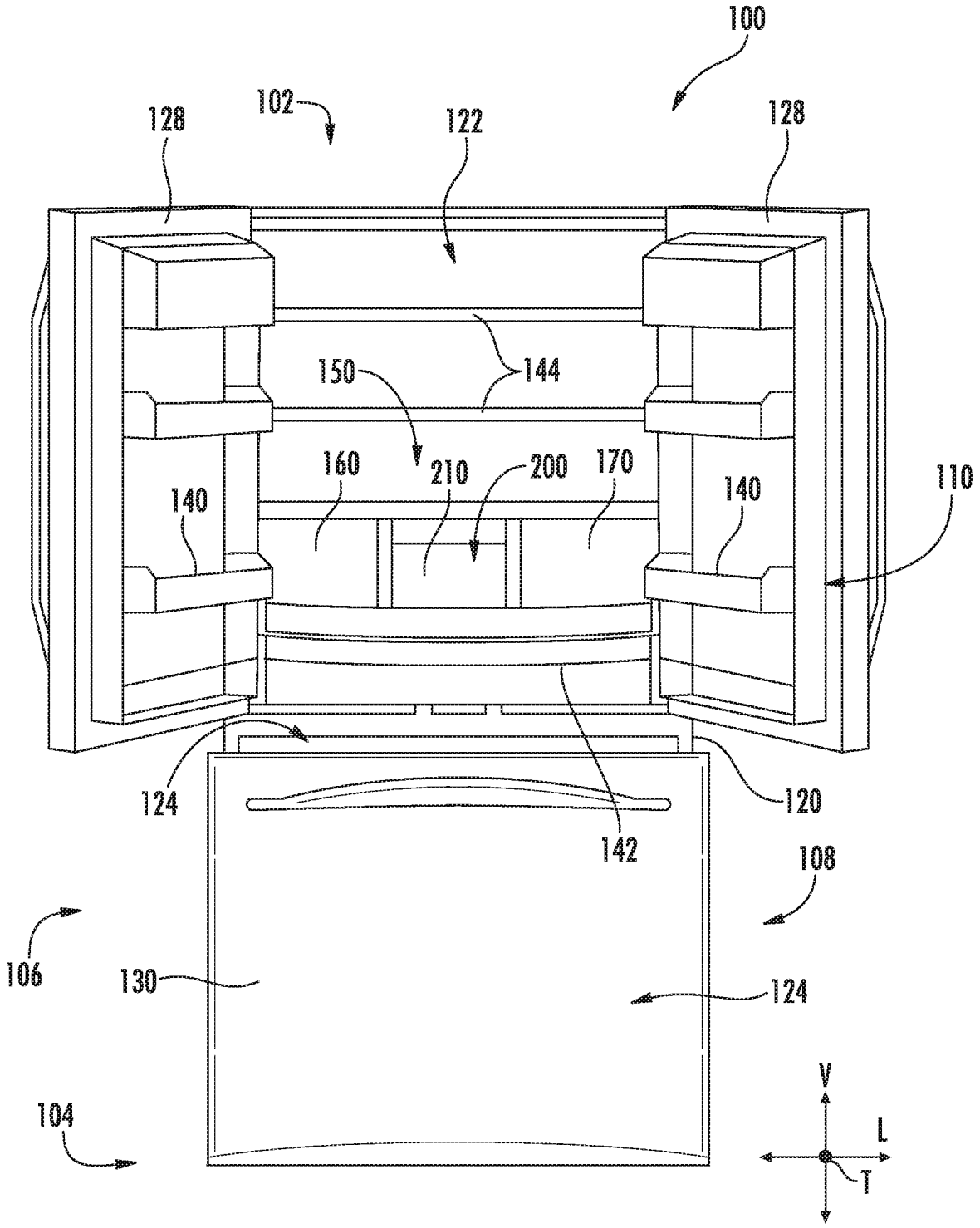
FIG. 2 provides a front, elevation view of the exemplary refrigerator appliance of FIG. 1 with refrigerator doors and a freezer door shown in an open position.

FIGS. 1 and 2 provide various views of an exemplary refrigerator appliance 100 according to an exemplary embodiment of the present subject matter. In particular, FIG. 1 provides a front, elevation view of refrigerator appliance 100 with refrigerator doors 128 and freezer door 130 of the refrigerator appliance 100 shown in a closed position. FIG. 2 provides a front view of refrigerator appliance 100 with refrigerator doors 128 and freezer door 130 shown in an open position. Refrigerator appliance 100 defines a vertical direction V, a lateral direction L, and a transverse direction T (extending into and out of the page in FIGS. 1 and 2). The vertical direction V, lateral direction L, and transverse direction T are mutually perpendicular and form an orthogonal direction system. Refrigerator appliance 100 includes a housing or cabinet 120 that extends between a top 102 and a bottom 104 along the vertical direction V, between a first side 106 and a second side 108 along the lateral direction L, and between a front side 110 and a rear side along the transverse direction T. As depicted, cabinet 120 defines chilled chambers for receipt of food items for storage. In particular, cabinet 120 defines fresh food chamber 122 positioned at or adjacent top 102 of cabinet 120 and a freezer chamber 124 arranged at or adjacent bottom 102 of cabinet 120. As such, refrigerator appliance 100 is generally referred to as a bottom mount refrigerator.

Refrigerator doors 128 are rotatably hinged to an edge of cabinet 120 for selectively accessing fresh food chamber 122. In addition, a freezer door 130 is arranged below refrigerator doors 128 for selectively accessing freezer chamber 124. Freezer door 130 is slidably mounted to cabinet 120 adjacent freezer chamber 124. Refrigerator doors 128 and freezer door 130 are shown in the closed position in FIG. 1, and refrigerator doors 128 and freezer door 130 are shown in the open position in FIG. 2. It should be appreciated, however, that in other exemplary embodiments, refrigerator appliance 100 may have any other suitable configuration. For example, in other exemplary embodiments, refrigerator appliance 100 may only include a single chilled chamber with a door slidably mounted adjacent thereto. Additionally, or alternatively, refrigerator appliance 100 may include refrigerator doors 128 slidably mounted adjacent to fresh food chamber 122.

As depicted in FIG. 2, various storage components are mounted within fresh food chamber 122 to facilitate storage of food items therein as will be understood by those skilled in the art. In particular, the storage components include door bins 140, drawers 142, and shelves 144 that are mounted within fresh food chamber 122. Bins 140, drawers 142, and shelves 144 are configured for receipt of food items (e.g., beverages and/or solid food items) and may assist with organizing such food items. As an example, drawers 142 can receive fresh food items (e.g., vegetables, fruits, and/or cheeses) and increase the useful life of such fresh food items.

In addition, for this exemplary embodiment, refrigerator appliance 100 includes a drawer system 150 that includes a first side drawer 160 positioned at or adjacent the first side 106 of refrigerator appliance 100, a second side drawer 170 positioned at or adjacent second side 108 of refrigerator appliance 100, and a drawer assembly 200 disposed between the first and second side drawers 160, 170, e.g., along the lateral direction L. Drawer assembly 200 includes a drawer 210. Each of the drawers 150, 160, 210 are configured for receipt of food items (e.g., beverages and/or solid food items) and may assist with organizing such food items. As will be explained in greater detail herein, drawer assembly 200 includes one or more bins disposed within drawer 210 that pull out to provide users with ready access to the bins. Such bins may provide compartments that facilitate organization of smaller food items, e.g., cans or condiment containers. Exemplary embodiments of drawer system 150 are provided below.

Figure 3:
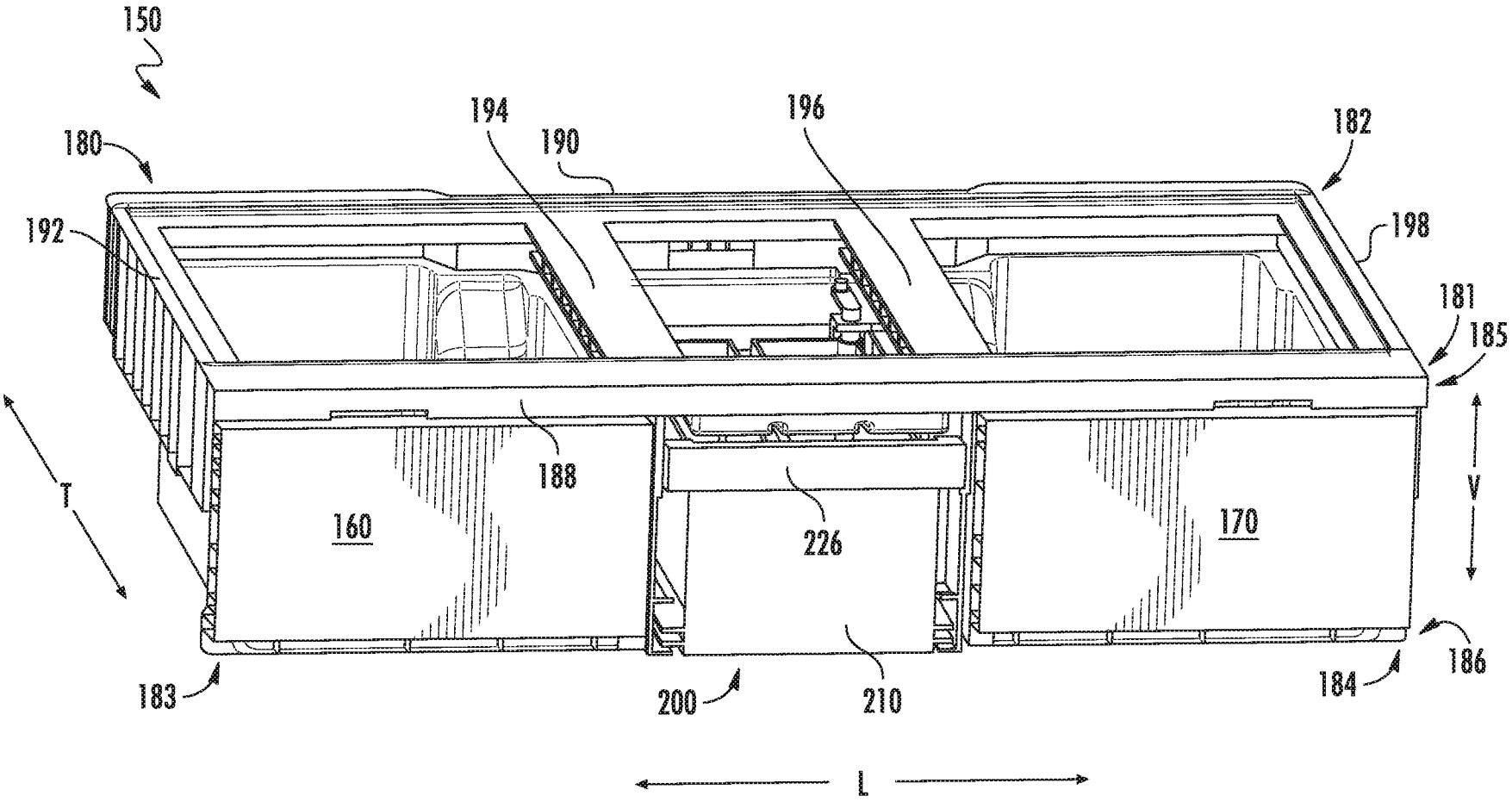
FIG. 3 provides a front perspective view of an exemplary drawer system according to an exemplary embodiment of the present subject matter.
Figure 4:
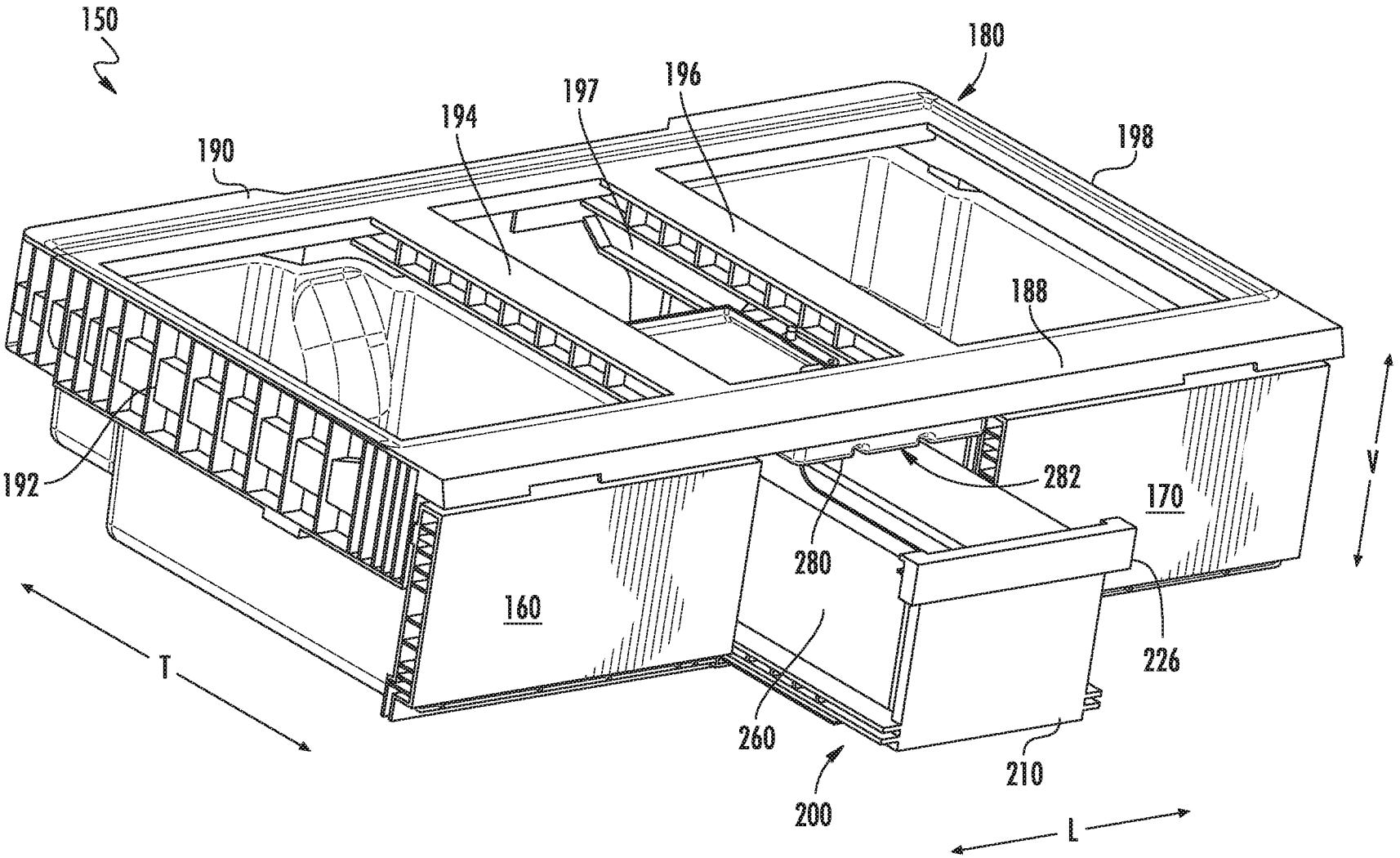
FIG. 4 provides a front perspective view of the drawer system of FIG. 3 depicting a drawer assembly being slid between a retracted position and a withdrawn position.
Figure 5:
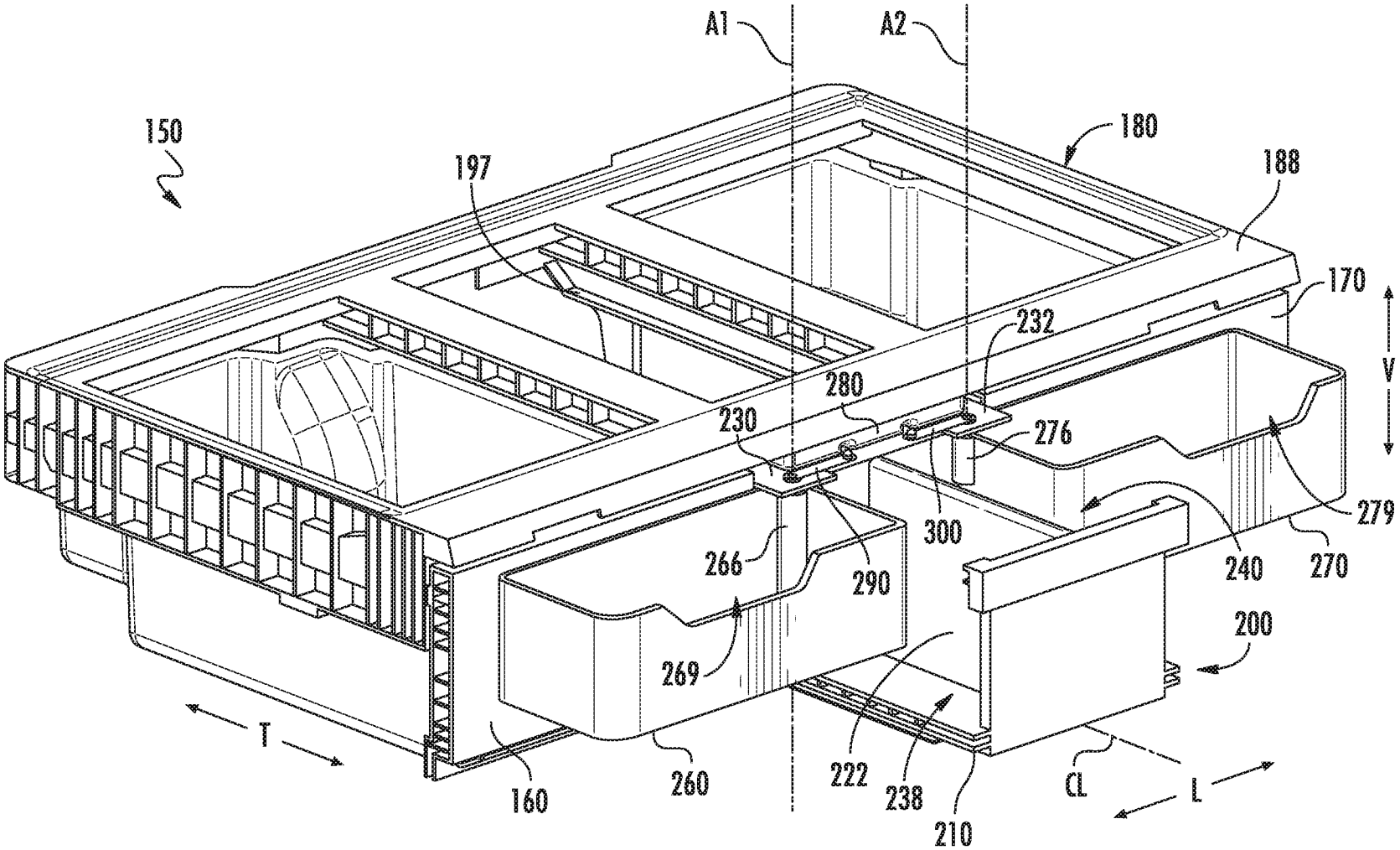
FIG. 5 provides a front perspective view of the drawer system of FIG. 3 depicting the drawer assembly in the withdrawn position and bins of the drawer assembly each rotated to an expanded position.
Figure 6:
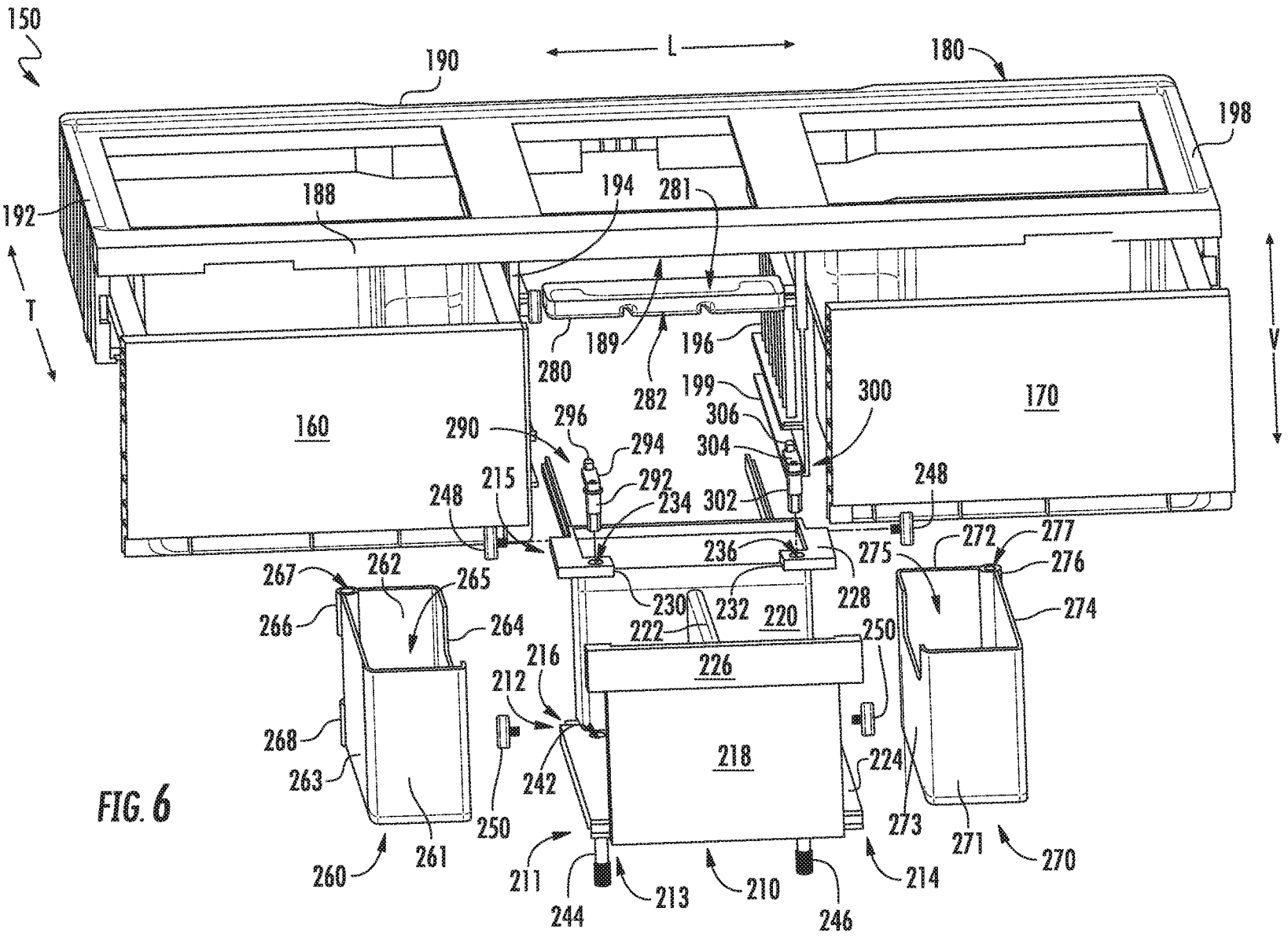
FIG. 6 provides a perspective exploded view of the drawer system of FIG. 3.
Figure 7:
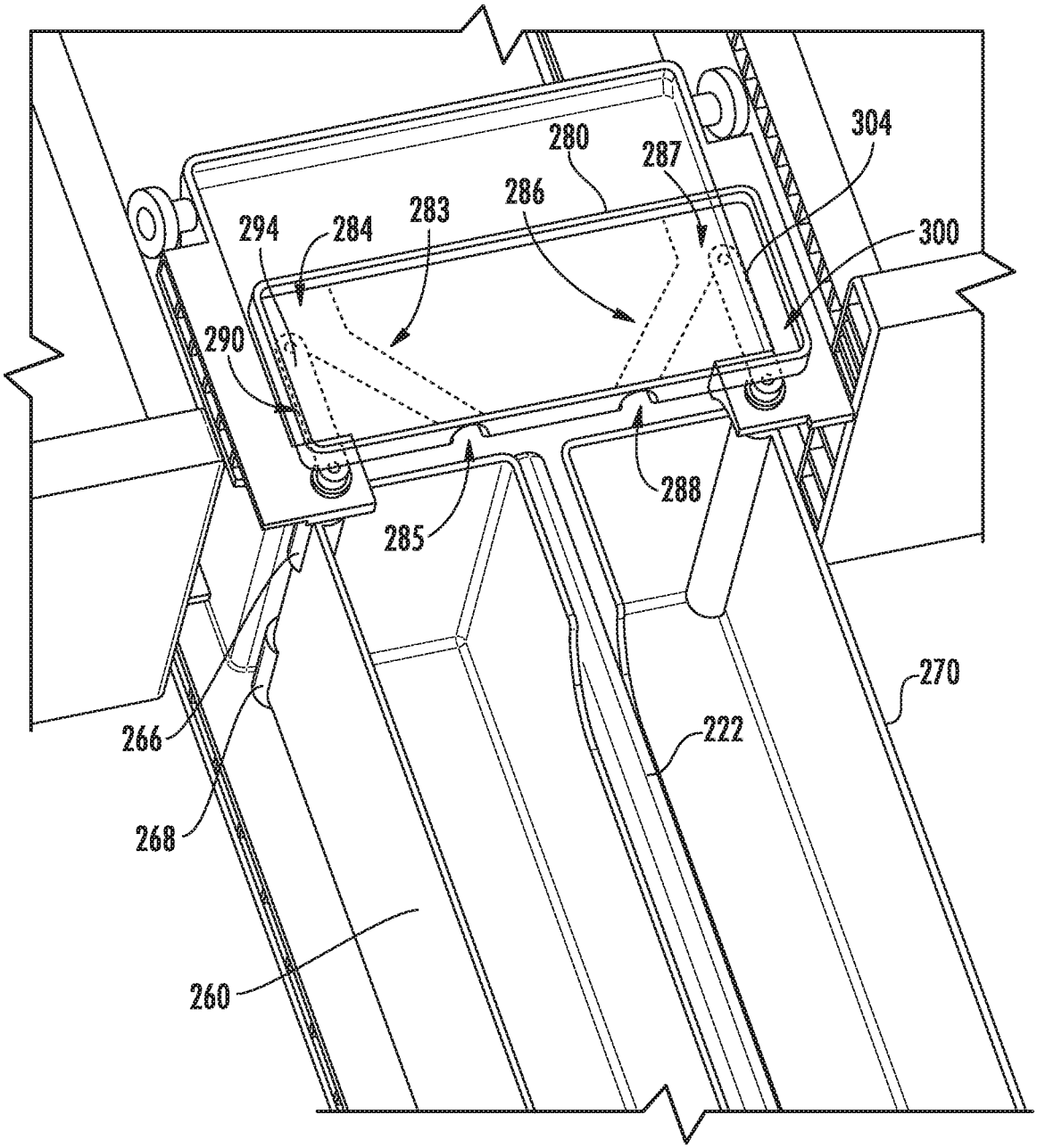
FIG. 7 provides a top perspective view of the drawer system of FIG. 3 depicting the bins of the drawer assembly received within a drawer of the drawer assembly in the received position.
Figure 8:
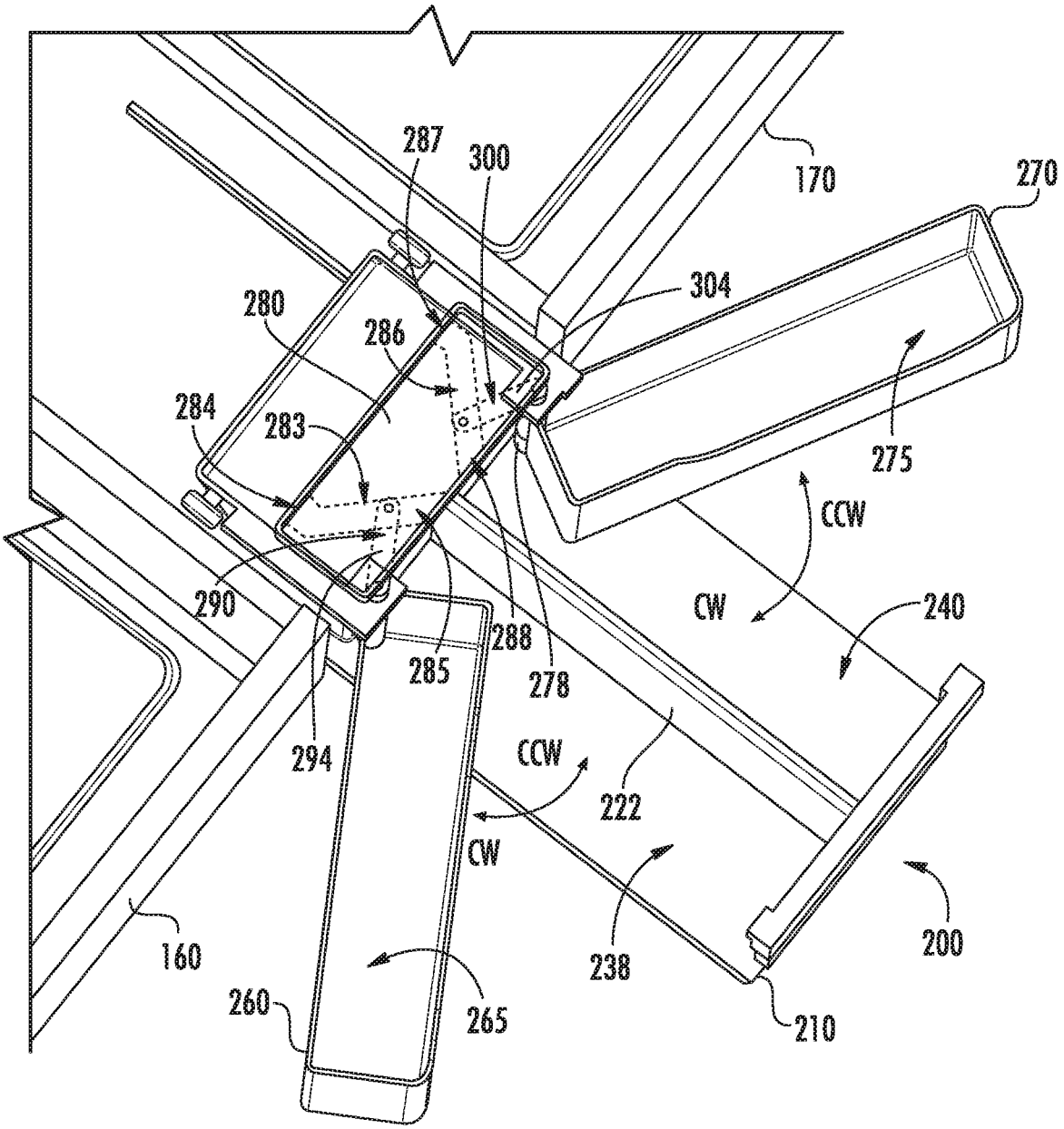
FIG. 8 provides a top perspective view of the drawer system of FIG. 3 depicting the bins of the drawer assembly being rotated about their respective rotational axes.

FIGS. 3 through 8 provide various views of one exemplary embodiment of drawer system 150 according to an exemplary embodiment of the present subject matter. In particular, FIG. 3 provides a front perspective view of drawer system 150. FIG. 4 provides a front perspective view thereof depicting drawer assembly being slid between a retracted position and a withdrawn position. FIG. 5 provides a front perspective view thereof depicting drawer assembly 200 in the withdrawn position and a first bin 260 and a second bin 270 of drawer assembly 200 each rotated to their respective expanded positions. FIG. 6 provides a perspective exploded view thereof. FIG. 7 provides a top perspective view thereof depicting the first and second bins 260, 270 of drawer assembly 200 received within drawer 210 of drawer assembly 200 in the received position. FIG. 8 provides a top perspective view thereof depicting the first and second bins 260, 270 of drawer assembly 200 being rotated about their respective rotational axes A1, A2.

As shown best in FIGS. 3 and 4, drawer system 150 defines a transverse direction T, a vertical direction V, and a lateral direction L. The transverse direction T, the vertical direction V, and the lateral direction L are mutually perpendicular and form an orthogonal direction system. Drawer system 150 includes a frame 180 extending between a front 181 and a back 182 along the transverse direction T, between a first side 183 and a second side 184 along the lateral direction L, and between a top 185 and a bottom 186 along the vertical direction V. Frame 180 has a front member 188 positioned at front 181 of frame 180 and a back member 190 positioned at the back 182 of frame 180 and spaced from front member 188 along the transverse direction T. Frame 180 also includes, a first end wall 192, a first wall 194, a second wall 196, and a second end wall 198 that each extend between and connect front member 188 and back member 190. Generally, the walls 192, 194, 196, 198 are spaced from one another along the lateral direction L and each wall 192, 194, 196, 198 extends in a plane orthogonal to the lateral direction L.

First side drawer 160 is slidably coupled with first end wall 192 and first wall 194 between a retracted position (shown best in FIGS. 3 and 4) and a withdrawn position (not shown) in which first side drawer 160 is slid outward from frame 180 along the transverse direction T such that first side drawer 160 is at least partially withdrawn from a chamber of the appliance, e.g., chilled chamber 122 of the refrigerator appliance 100 of FIGS. 1 and 2. More particularly, first side drawer 160 includes a pair of opposed rails and frame 180 includes a pair of opposing tracks, one of which is defined by first end wall 192 and one of which is defined by first wall 194. The rails of the first side drawer 160 are configured to slide along or within a corresponding rail so that first side drawer 160 may be moved between the retracted and withdrawn positions.

In a similar fashion, second side drawer 170 is slidably coupled with second end wall 198 and second wall 196 between a retracted position (shown best in FIGS. 3 and 4) and a withdrawn position (not shown) in which second side drawer 170 is slid outward from frame 180 along the transverse direction T such that second side drawer 170 is at least partially withdrawn from a chamber of the appliance. More particularly, second side drawer 170 includes a pair of opposed rails and frame 180 includes a pair of opposing tracks, one of which is defined by second end wall 198 and one of which is defined by second wall 196. The rails of second side drawer 170 are configured to slide along or within a corresponding rail so that second side drawer 170 may be moved between the retracted and withdrawn positions.

Further, drawer assembly 200 is configured to slide or move between a retracted position and a withdrawn position along the transverse direction T. Drawer assembly 200 is best shown in the retracted position in FIG. 3 and is best shown in the withdrawn position in FIG. 5. Drawer assembly 200 is shown in FIG. 4 transitioning between the retracted position and the withdrawn position. Drawer 210 of drawer assembly 200 is slidably coupled with frame 180, which may be in turn be coupled with cabinet 120 of refrigerator appliance 100 (FIG. 1), for example. In this way, drawer 210 may be slidably coupled with cabinet 120. Drawer 210 is configured to be received within a chamber (e.g., chilled chamber 122 of FIG. 2) in the retracted position and at least partially withdrawn from the chamber in the withdrawn position. This may, for example, provide users with ready access to the interior compartments of drawer assembly 200.

As shown best in FIG. 6, drawer 210 of drawer assembly 200 extends between a front 211 and a back 212 along the transverse direction T, between a first side 213 and a second side 214 along the lateral direction L, and between a top 215 and a bottom 216 along the vertical direction V. Drawer 210 has a front wall 218 positioned at front 211 of drawer 210 and a back wall 220 positioned at back 212 of drawer 210 and spaced from front wall 218 along the transverse direction T. Front wall 218 includes a handle 226 that allows a user to slide or move drawer assembly 200 between the retracted and the withdrawn positions. Back wall 220 includes a top flange 228 that extends along the length of back wall 220 along the lateral direction L. Top flange 228 also extends along the transverse direction T at both first side 213 and second side 214 of drawer 210. Moreover, at the forward end of top flange 228 at first side 213, top flange 228 includes a first cantilevered portion 230 that projects inward toward a centerline CL (FIG. 5) of drawer assembly 200. Centerline CL is defined by drawer assembly 200 along the lateral direction L and extends along the transverse direction T. At the forward end of top flange 228 at second side 214, top flange 228 includes a second cantilevered portion 232 that projects inward toward the centerline CL of drawer assembly 200. The first cantilevered portion 230 defines a first aperture 234 and second cantilevered portion 232 defines a second aperture 236. For this embodiment, first aperture 234 and second aperture 236 are both circular openings.

Further, as shown best in FIGS. 6 and 8, a partition wall 222 extends between and connects front wall 218 and back wall 220 along the transverse direction T. For this embodiment, partition wall 222 is spaced midway between the first side 213 and second side 214 of drawer 210. Partition wall 222 partitions the interior volume of drawer 210 into a first volume 238 and a second volume 240. In addition, drawer 210 has a base plate 224 to which front wall 218, back wall 220, and partition wall 222 are connected. Base plate 224 defines a first opening 242 proximate where back wall 220 connects with base plate 224. Similarly, in a mirrored fashion, base plate 224 defines a second opening 243 (FIG. 11) where back wall 220 connects with base plate 224. First opening 242 and second opening 243 are each sized to receive hinge pins 244, 246, respectively.

As noted above, drawer 210 is slidably coupled with frame 180. Drawer 210 includes a plurality of rollers mounted thereto. In particular, for this embodiment, drawer 210 includes top rollers 248 mounted to drawer 210 at or proximate top 215 of drawer 210. One of the top rollers 248 is mounted to first side 213 of back wall 220 and one of the top rollers 248 is mounted to second side 214 of back wall 220 of drawer 210. Further, drawer 210 includes two (2) bottom rollers 250 mounted to drawer 210 at or proximate bottom 216 of drawer 210. One of the bottom rollers 250 is mounted to first side 213 of back wall 220 and one of the bottom rollers 250 is mounted to second side 214 of back wall 220 of drawer 210. Frame 180 includes a pair of opposing top tracks 197, one of which is defined by first wall 194 and one of which is defined by second wall 196, and a pair of opposing bottom tracks 199, one of which is defined by first wall 194 and one of which is defined by second wall 196. The top rollers 248 are configured to roll along a corresponding top track 197 of frame 180 and bottom rollers 250 are configured to roll along a corresponding bottom track 199 so that drawer assembly 200 may be slide or moved between the retracted and withdrawn positions. In some exemplary embodiments, drawer assembly 200 may include self-closing or soft closing features, e.g., to facilitate closing of drawer assembly 210.

As depicted, drawer assembly 200 includes a first bin 260 rotatably coupled with drawer 210 about the vertical direction V between a received position (FIGS. 4 and 7) and an expanded position (FIG. 5). Drawer assembly 200 also includes a second bin 270 rotatably coupled with the drawer 210 about the vertical direction V between a received position (FIGS. 4 and 7) and an expanded position (FIG. 5).

FIG. 8 depicts first bin 260 and second bin 270 transitioning between their respective received and expanded positions. When first bin 260 is in the received position, first bin 260 is received within drawer 210. More particularly, first bin 260 is received within first volume 238 defined by drawer 210, and particularly by partition wall 222, front wall 218, and back wall 220. Similarly, when second bin 270 is in the received position, second bin 270 is received within drawer 210. More particularly, second bin 270 is received within second volume 240 defined by drawer 210, and particularly by partition wall 222, front wall 218, and back wall 220 of drawer 210. In contrast, when first bin 260 is in the expanded position, first bin 260 is rotated outward from drawer 210 about the vertical direction V. For instance, as shown best in FIG. 5, when first bin 260 is rotated outward from drawer 210 in the expanded position, the length of first bin 260 may extend along the lateral direction L (in contrast, the length of first bin 260 extends along the transverse direction T when first bin 260 is in the received position). Similarly, when second bin 270 is in the expanded position, second bin 270 is rotated outward from drawer 210 about the vertical direction V. For instance, as shown best in FIG. 5, when second bin 270 is rotated outward from drawer 210 in the expanded position, the length of second bin 270 may extend along the lateral direction L (in contrast, the length of second bin 270 extends along the transverse direction T when second bin 270 is in the received position).

As illustrated in FIG. 6, first bin 260 extends between a front wall 261 and a back wall 262 along the transverse direction T and between a first sidewall 263 and a second sidewall 264 along the lateral direction L. First sidewall 263 and second sidewall 264 extend between and connect front wall 261 with back wall 262. A base wall connects each of the walls at the bottom of first bin 260. The walls of first bin 260 define a first bin volume 265 in which food items may be stored. As noted above, first bin 260 is rotatably coupled with drawer 210. First bin 260 includes a first hinge 266. For this embodiment, first hinge 266 is molded integrally with back wall 262 and first sidewall 263 of first bin 260. First hinge 266 defines a hinge opening 267 that extends along the vertical direction V. In this way, first hinge 266 defines a first rotation axis A1. For this embodiment, hinge opening 267 has a hexagonal cross section as viewed along the vertical direction V. However, in alternative exemplary embodiments, hinge opening 267 may have other non-circular geometries as viewed along the vertical direction V, such as e.g., a pentagonal cross section. Further, first bin 260 includes a bottom hinge 268 that defines a bottom hinge opening along the first rotation axis A1. The bottom hinge opening of the bottom hinge 268 is sized to receive first hinge pin 244 and is in mating alignment with first opening 242 defined by base plate 224 of drawer 210. First hinge pin 244 may be inserted through first opening 242 in base plate 224 and into bottom hinge 268 of first bin 260. In this manner, first hinge pin 244 facilitates rotation of first bin 260 about the vertical direction V, or more particularly, about the first rotation axis A1. In addition, as shown best in FIG. 5, first bin 260 defines an access cutout 269. In particularly, second sidewall 264 (FIG. 6) of first bin 260 defines the access cutout 269 along an upper lip of the wall. Access cutout 269 facilitates access to first bin 260 and removal of food items, e.g., when first bin 260 is rotated to the expanded position as shown in FIG. 5.

Similarly, as depicted best in FIG. 6, second bin 270 extends between a front wall 271 and a back wall 272 along the transverse direction T and between a first sidewall 273 and a second sidewall 274 along the lateral direction L. First sidewall 273 and second sidewall 274 extend between and connect front wall 271 with back wall 272. A base wall connects each of the walls at the bottom of second bin 270. The walls of second bin 270 define a second bin volume 275 in which food items may be stored. As noted previously, second bin 270 is rotatably coupled with drawer 210. More particularly, second bin 270 includes a second hinge 276. For this embodiment, second hinge 276 is molded integrally with back wall 272 and second sidewall 274 of second bin 270. Second hinge 276 defines a hinge opening 277 that extends along the vertical direction V. In this way, second hinge 276 defines a second rotation axis A2. For this embodiment, hinge opening 277 has a hexagonal cross section as viewed along the vertical direction V. However, in alternative exemplary embodiments, hinge opening 277 may have other non-circular geometries as viewed along the vertical direction V, such as e.g., a pentagonal cross section. Further, second bin 270 includes a bottom hinge 278 that defines a bottom hinge opening along the second rotation axis A2. The bottom hinge opening of bottom hinge 278 is sized to receive second hinge pin 246 and is in mating alignment with the second opening 243 defined by base plate 224 of drawer 210. Second hinge pin 246 may be inserted through second opening 243 in base plate 224 and into bottom hinge 278 of second bin 270. In this manner, second hinge pin 246 facilitates rotation of second bin 270 about the vertical direction V, or more particularly the second rotation axis A2. Further, as shown best in FIG. 5, second bin 270 defines an access cutout 279. In particularly, first sidewall 273 (FIG. 6) of second bin 270 defines the access cutout 279 along an upper lip of the wall. Access cutout 270 facilitates access to second bin 270 and removal of food items, e.g., when second bin 270 is rotated to the expanded position as shown in FIG. 5.

For the depicted embodiment of FIGS. 3 through 8, when drawer assembly 200 is slid to the withdrawn position, first bin 260 and second bin 270 automatically rotate to their respective expanded positions. Accordingly, drawer assembly 200 includes features that automatically move or rotate first and second bins 260, 270 to their respective expanded positions. More particularly, as shown in FIG. 6, drawer assembly 200 includes a first striker 290 and a second striker 300. First striker 290 has a shaft portion 292 and a striker arm 294. The shaft portion 292 extends along the first rotation axis A1 (FIG. 5) and is received through the first aperture 234 of drawer 210 and within first hinge 266 of first bin 260, or more particularly, the hinge opening 267 of first hinge 266. For this embodiment, shaft portion 292 has a hexagonal cross section when viewed along the vertical direction V such that shaft portion 292 has a complementary geometry to hinge opening 267 of first hinge 266. However, in other exemplary embodiments, shaft portion 292 may have other suitable non-circular geometries that are complementary to hinge opening 267 of first hinge 266. Striker arm 294 projects from shaft portion 292 along a direction orthogonal to the vertical direction V. Striker arm 294 includes a striker head 296 at its distal end that projects from striker arm 294 along the vertical direction V. For this embodiment, striker head 296 has a spherical or ball-like shape.

In a similar way, second striker 300 has a shaft portion 302 and a striker arm 304. The shaft portion 302 extends along the second rotation axis A2 (FIG. 5) and is received through the second aperture 236 of drawer 210 and within second hinge 276 of second bin 270, or more particularly, the hinge opening 277 of second hinge 276. For this embodiment, shaft portion 302 has a hexagonal cross section when viewed along the vertical direction V such that shaft portion 302 has a complementary geometry to hinge opening 277 of second hinge 276. However, in other exemplary embodiments, shaft portion 302 may have other suitable non-circular geometries that are complementary to hinge opening 277 of second hinge 276. Striker arm 304 projects from shaft portion 302 along a direction orthogonal to the vertical direction V. Striker arm 304 includes a striker head 306 at its distal end that projects from striker arm 304 along the vertical direction V. For this embodiment, striker head 306 has a spherical or ball-like shape.

As shown best in FIGS. 5 and 6, drawer system 150 includes a guide plate 280. Guide plate 280 has a top surface 281 and an opposing bottom surface 282. Guide plate 280 is coupled with frame 180. More specifically, guide plate 280 is coupled with front member 188 of frame 180 and is thus positioned at front 181 of frame 180. More specifically still, top surface 281 of guide plate 280 is coupled or connected with a bottom surface 189 of front member 188.

As shown best in FIGS. 7 and 8 (front member 188 of frame 180 is transparent in FIGS. 7 and 8), guide plate 280 defines a first groove 283 and a second groove 286. More particularly, bottom surface 282 of guide plate 280 defines first groove 283 and second groove 286. First groove 283 and second groove 286 are defined by guide plate 280 spaced from one another along the lateral direction L. First groove 283 extends generally between a mouth 284 positioned at a back of guide plate 280 and a terminal end 285. Terminal end 285 is positioned inward of mouth 284 along the lateral direction L with respect to centerline CL (FIG. 5). More particularly, for this embodiment, first groove 283 extends inward, e.g., along the lateral direction L, at an angle with respect to the centerline CL from mouth 284 to terminal end 285. However, in alternative exemplary embodiments, first groove 283 may have an alternative geometry. For example, first groove 283 may have an arcuate shape when viewed along the vertical direction V with terminal end 285 positioned inward of mouth 284 along the lateral direction L. In a similar fashion, second groove 286 extends generally between a mouth 287 positioned at a back of guide plate 280 and a terminal end 288. Terminal end 288 is positioned inward of mouth 287 along the lateral direction L with respect to the centerline CL. More specifically, for this embodiment, second groove 286 extends inward, e.g., along the lateral direction L, at an angle with respect to the centerline CL from mouth 287 to terminal end 288. However, in alternative exemplary embodiments, second groove 286 may have an alternative geometry. For example, second groove 286 may have an arcuate shape when viewed along the vertical direction V with terminal end 288 positioned inward of mouth 287 along the lateral direction L.

When drawer assembly 200 is slid from the retracted position to the withdrawn position, striker arm 294 of first striker 290 is received within first groove 283 and is slid along first groove 283 to drive first bin 260 about the first rotation axis A1 (FIG. 5) to rotate first bin 260 to the expanded position. More particularly, as shown in FIG. 7, as drawer assembly 200 is slid from the retracted position toward the withdrawn position, striker head 296 (FIG. 6) of striker arm 294 of first striker 290 is received by mouth 284 of first groove 283 of guide plate 280. As shown particularly in FIG. 8, as drawer assembly 200 continues to be slid toward the withdrawn position, striker arm 294 of first striker 290 moves along first groove 283 from mouth 284 toward terminal end 285. The rotation of striker arm 294 of first striker 290 about the first rotation axis A1 causes first bin 260 to rotate outward from drawer 210 toward the expanded position. First bin 260 is rotated in a clockwise direction CW (from the perspective of FIG. 8) about first rotation axis A1 when first bin 260 is rotated from the received position toward the expanded position. As shown best in FIG. 5, when first bin 260 is positioned in the expanded position, striker arm 294 of first striker 290 is positioned at terminal end 285 of first groove 283. When first bin 260 is rotated to the expanded position, first bin 260 may be readily accessed by a user and the contents within first bin 260 are presented to the user in a user-friendly manner.

In a similar fashion, when drawer assembly 200 is slid from the retracted position to the withdrawn position, striker arm 304 of second striker 300 is received within second groove 286 and is slid along second groove 286 to drive second bin 270 about the second rotation axis A2 (FIG. 5) to rotate second bin 270 to the expanded position. As shown best in FIG. 7, as drawer assembly 200 is slid from the retracted position toward the withdrawn position, striker head 306 (FIG. 6) of striker arm 304 of second striker 300 is received by mouth 287 of second groove 286 of guide plate 280. As drawer assembly 200 continues to be slid toward the withdrawn position as shown in FIG. 8, striker arm 304 of second striker 300 moves along second groove 286 from mouth 287 toward terminal end 288. The rotation of striker arm 304 of second striker 300 about the second rotation axis A2 causes second bin 270 to rotate outward from drawer 210 toward the expanded position. Second bin 270 is rotated in a counter clockwise direction CCW (from the perspective of FIG. 8) about second rotation axis A2 when second bin 270 is rotated from the received position toward the expanded position. Thus, first bin 260 and second bin 270 rotate about the vertical direction V, and more particularly their respective first and second rotation axes A1, A2, in opposite directions when rotating from their respective received positions to their respective expanded positions. As best shown in FIG. 5, when second bin 270 is positioned in the expanded position, striker arm 304 of second striker 300 is positioned at terminal end 288 of second groove 286. When second bin 270 is rotated to the expanded position, second bin 270 may be readily accessed by a user and the contents within second bin 270 are presented to the user in a user-friendly manner.

When drawer assembly 200 is slid from the withdrawn position to the retracted position (e.g., by a user pushing on handle 226 of drawer 210 along the transverse direction T), striker head 296 (FIG. 6) of striker arm 294 of first striker 290 received within first groove 283 is slid along first groove 283 to drive first bin 260 about the first rotation axis A1 to rotate first bin 260 inward (with respect to centerline CL) to the received position. As drawer assembly 200 is slid toward the retracted position, striker arm 294 of first striker 290 moves along first groove 283 toward mouth 284. First bin 260 is rotated about the first rotation axis A1 in a counter clockwise direction CCW (from the perspective of FIG. 8) when first bin 260 is rotated from the expanded position toward the received position. After first bin 260 is positioned in the received position within first volume 238 of drawer 210 and drawer assembly 200 is further moved toward the retracted position, striker arm 294 of first striker 290 exits mouth 284 of first groove 283.

In a similar fashion, when drawer assembly 200 is slid from the withdrawn position to the retracted position, striker head 306 (FIG. 6) of striker arm 304 of second striker 300 received within second groove 286 is slid along second groove 286 to drive second bin 270 about the second rotation axis A2 to rotate second bin 270 inward (with respect to centerline CL) to the received position. As drawer assembly 200 is slid toward the retracted position, striker arm 304 of second striker 300 moves along second groove 286 toward mouth 287. Second bin 270 is rotated about the second rotation axis A2 in a clockwise direction CW (from the perspective of FIG. 8) when second bin 270 is rotated from the expanded position toward the received position. Thus, first bin 260 and second bin 270 rotate about the vertical direction V, and more particularly their respective first and second rotation axes A1, A2, in opposite directions when rotating from their respective expanded positions to their respective received positions. After second bin 270 is positioned in the received position within second volume 240 of drawer 210 and drawer assembly 200 is further moved toward the retracted position, striker arm 304 of second striker 300 exits mouth 287 of second groove 286. First bin 260 and second bin 270 may be rotated automatically from their respective received positions to their respective expanded positions in synchronization or in a synchronized fashion. Further, first bin 260 and second bin 270 may be rotated automatically from their respective expanded positions to their respective received positions in synchronization or in a synchronized fashion. In some exemplary embodiments, the self-opening or automatic bin opening features may be disengaged such that first and second bins 260, 270 must be manually rotated about their respective axes A1, A2.

Figure 9:
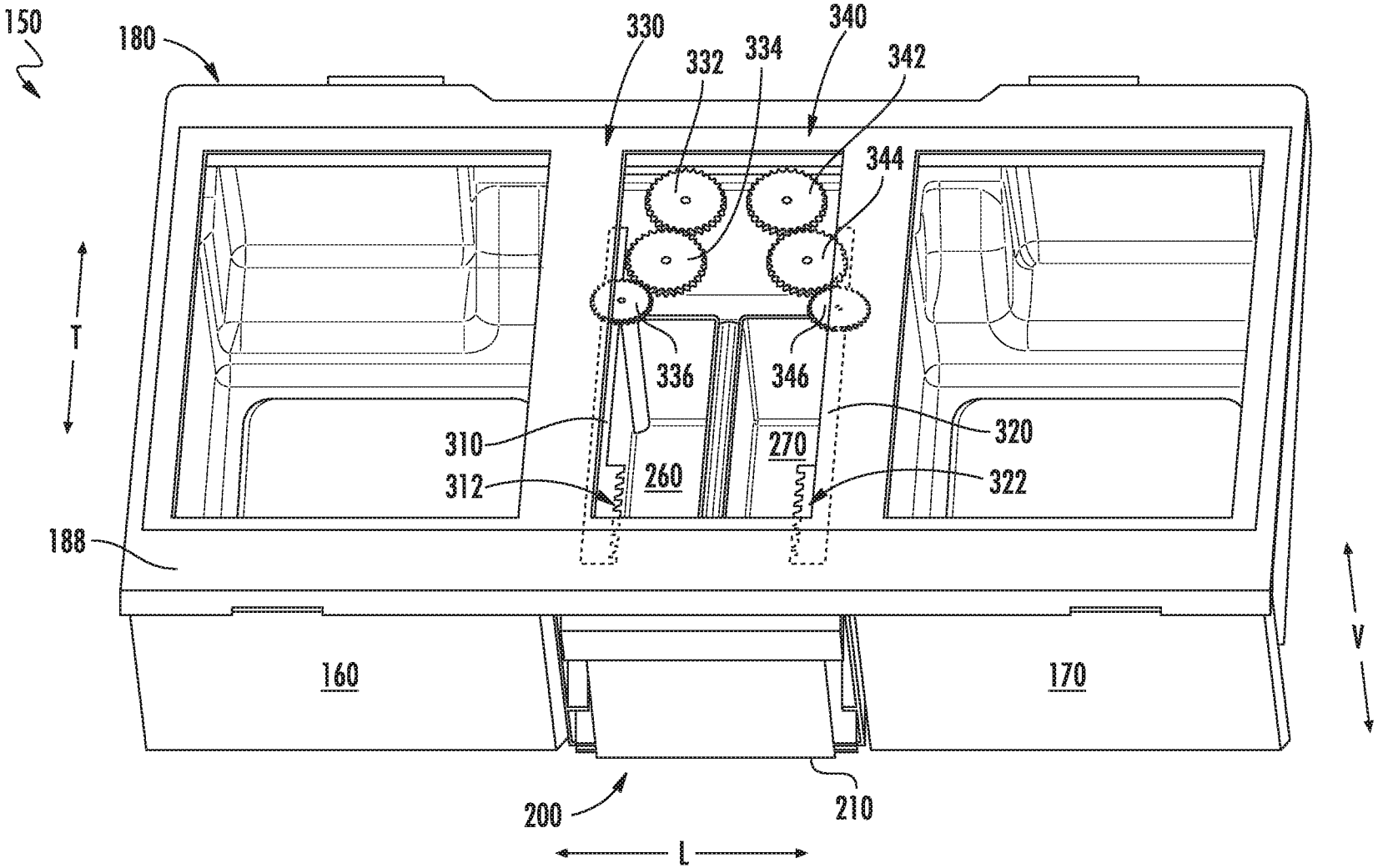
FIG. 9 provides a perspective view of another exemplary drawer system according to an exemplary embodiment of the present subject matter.
Figure 10:
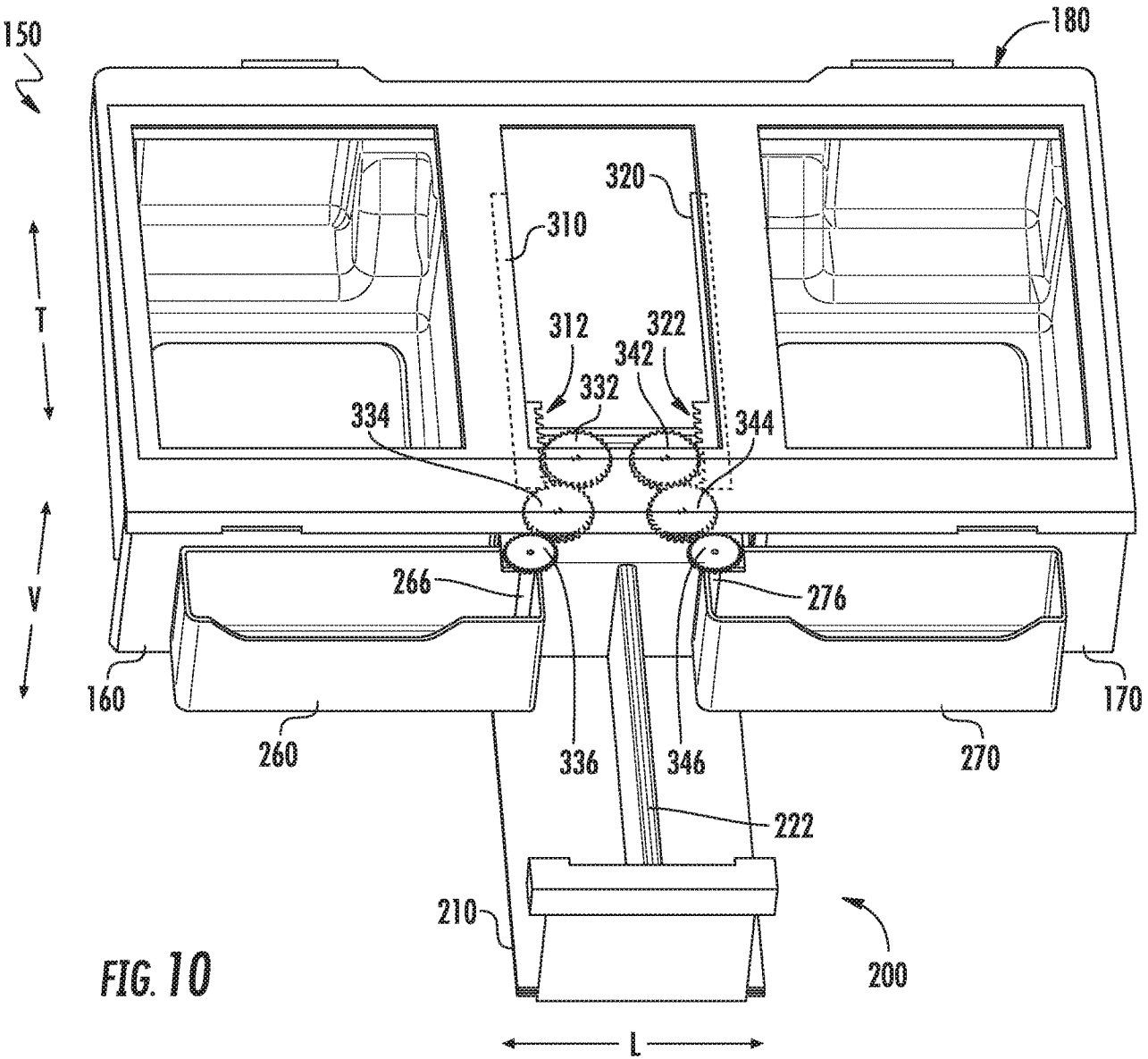
FIG. 10 provides a perspective view of the drawer system of FIG. 9 depicting a drawer assembly in a withdrawn position and bins of the drawer assembly both in expanded positions.
Figure 11:
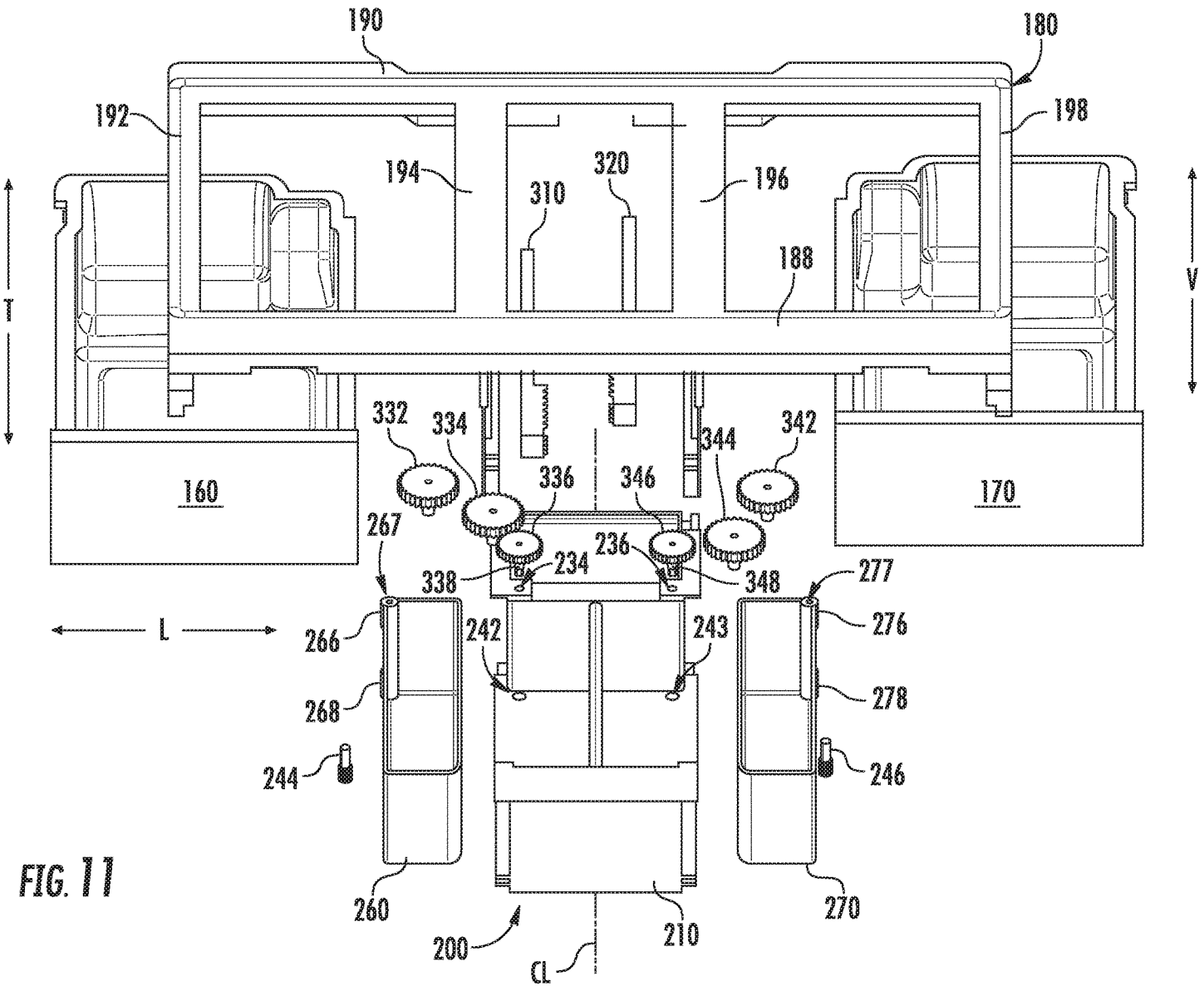
FIG. 11 provides a perspective exploded view of the drawer system of FIG. 9.

FIGS. 9 through 11 provide various views of another exemplary embodiment of drawer system 150 according to an exemplary embodiment of the present subject matter. In particular, FIG. 9 provides a perspective view of drawer system 150 with drawer assembly 200 in a retracted position. FIG. 10 provides a perspective view of the drawer system 150 of FIG. 9 depicting drawer assembly 200 in the withdrawn position and first and second bins 260, 270 rotated to their respective expanded positions. FIG. 11 provides a perspective exploded view of the drawer system of FIG. 9. The exemplary drawer system 150 of FIGS. 9 through 11 is configured in a similar manner as the drawer system of FIGS. 3 through 8, and accordingly, the same or similar numbering refers to the same or similar part.

For the depicted embodiment of FIGS. 9 through 11, when drawer assembly 200 is slid to the withdrawn position, first bin 260 and second bin 270 automatically rotate to their respective expanded positions. However, in contrast with the embodiment of FIGS. 3 through 8, drawer assembly 200 of FIGS. 9 through 11 includes different features that automatically move or rotate first and second bins 260, 270 to their respective expanded positions. As shown, for this embodiment, drawer system 150 includes a geared features that facilitate automatic rotation of first and second bins 260, 270 to their respective expanded positions when drawer assembly 200 is moved to the withdrawn position and automatic rotation of first and second bins 260, 270 to their respective received positions when drawer assembly 200 is moved toward the retracted position.

Drawer system 150 includes a first track 310 coupled with frame 180. In particular, first track 310 is coupled with first wall 194 of frame 180. First track 310 includes a geared portion 312 that extends from the front end of the first track 310 along a portion of the transverse length of first track 310. For instance, for this embodiment, geared portion 312 of first track 310 extends along about one third of the transverse length of first track 310. The teeth of the geared portion 312 of first track 310 face inward with respect to the centerline CL. Drawer system 150 also includes a second track 320 coupled with frame 180. More particularly, second track 320 is coupled with second wall 196 of frame 180. Second track 320 is spaced from first track 310 along the lateral direction L and opposes first track 310. Like first track, second track 320 includes a geared portion 322 that extends from the front end of second track 320 along a portion of the transverse length of second track 320. For instance, for this embodiment, geared portion 322 of second track extends along about one third of the transverse length of second track 320. The teeth of geared portion 322 of second track 320 face inward with respect to the centerline CL.

Drawer assembly 200 of drawer system 150 includes a first gear train 330 and a second gear train 340. First gear train 330 includes a drive gear 332 rotatably coupled with drawer 210 and positioned at the back portion of first gear train 330. First gear train 330 also includes an idler gear 334 rotatably coupled with drawer 210. Drive gear 332 is in meshing engagement with idler gear 334. That is, the teeth of drive gear 332 are in mechanical engagement with the teeth of idler gear 334. First gear train 330 also includes a lead gear 336 positioned at the front portion of first gear train 330. Idler gear 334 is in meshing engagement with lead gear 336. Lead gear 336 has a shaft portion 338 extending along the first rotation axis A1. Shaft portion 338 is received through first aperture 234 of drawer 210 and within first hinge 266 of first bin 260, and more particularly hinge opening 267 of first hinge 266. For this embodiment, shaft portion 338 of lead gear 336 has a hexagonal cross section when viewed along the vertical direction V such that shaft portion 338 has a complementary geometry to hinge opening 267 of first hinge 266. However, in other exemplary embodiments, shaft portion 338 may have other suitable non-circular geometries that are complementary to hinge opening 267 of first hinge 266.

Like first gear train 330, second gear train 340 includes a drive gear 342 rotatably coupled with drawer 210 and positioned at the back portion of second gear train 340. Second gear train 340 also includes an idler gear 344 rotatably coupled with drawer 210. Drive gear 342 is in meshing engagement with idler gear 344. That is, the teeth of drive gear 342 are in mechanical engagement with the teeth of idler gear 344. Second gear train 340 also includes a lead gear 346 positioned at the front portion of second gear train 340. Idler gear 344 is in meshing engagement with lead gear 346. Lead gear 346 has a shaft portion 348 extending along the second rotation axis A2. Shaft portion 348 is received through second aperture 236 of drawer 210 and within second hinge 276 of second bin 270, and more particularly hinge opening 277 of second hinge 276. For this embodiment, shaft portion 348 of lead gear 346 has a hexagonal cross section when viewed along the vertical direction V such that shaft portion 348 has a complementary geometry to hinge opening 277 of second hinge 276. However, in other exemplary embodiments, shaft portion 348 may have other suitable non-circular geometries that are complementary to hinge opening 277 of second hinge 276.

When drawer assembly 200 is slid from the retracted position to the withdrawn position, drive gear 332 of first gear train 330 engages geared portion 312 of first track 310 in meshing engagement to drive idler gear 334. Idler gear 334 in turn drives lead gear 336 to drive first bin 260 about the first rotation axis A1 to rotate first bin 260 to the expanded position. In particular, as lead gear 336 is driven about the first rotation axis A1, shaft portion 338 of lead gear 336 engages first hinge 266 and shaft portion 338 of lead gear 336 drivingly rotates first bin 260 from the received position to the expanded position, e.g., as shown in FIG. 10. In unison, when drawer assembly 200 is slid from the retracted position to the withdrawn position, drive gear 342 of second gear train 340 engages geared portion 322 of second track 320 in meshing engagement to drive idler gear 344. Idler gear 344 in turn drives lead gear 346 to drive second bin 270 about the second rotation axis A2 to rotate second bin 270 to the expanded position. In particular, as lead gear 346 is driven about the second rotation axis A2, shaft portion 348 of lead gear 346 engages second hinge 276 and shaft portion 348 of lead gear 346 drivingly rotates second bin 270 from the received position to the expanded position as shown in FIG. 10.

In contrast, when drawer assembly 200 is slid or moved from the withdrawn position to the retracted position, drive gear 332 of first gear train 330 engaged with geared portion 312 of first track 310 in meshing engagement drives idler gear 334. Particularly, drive gear 332 drives idler gear 334 about the vertical direction V in a direction opposite the direction that idler gear 334 is driven when drawer assembly 200 is moved toward the withdrawn position. When idler gear 334 is driven by drive gear 332, idler gear 334 in turn drives lead gear 336 of first gear train 330 to drive first bin 260 about the first rotation axis A1 to rotate first bin 260 to the received position. At the same time, when drawer assembly 200 is slid or moved from the withdrawn position to the retracted position, drive gear 342 of second gear train 340 engaged with geared portion 322 of second track 320 in meshing engagement drives idler gear 344. More specifically, drive gear 342 drives idler gear 344 about the vertical direction V in a direction opposite the direction that idler gear 344 is driven when drawer assembly 200 is moved toward the withdrawn position. When idler gear 344 is driven by drive gear 342, idler gear 344 in turn drives lead gear 346 of second gear train 340 to drive second bin 270 about the second rotation axis A2 to rotate second bin 270 to the received position.

Figure 12:
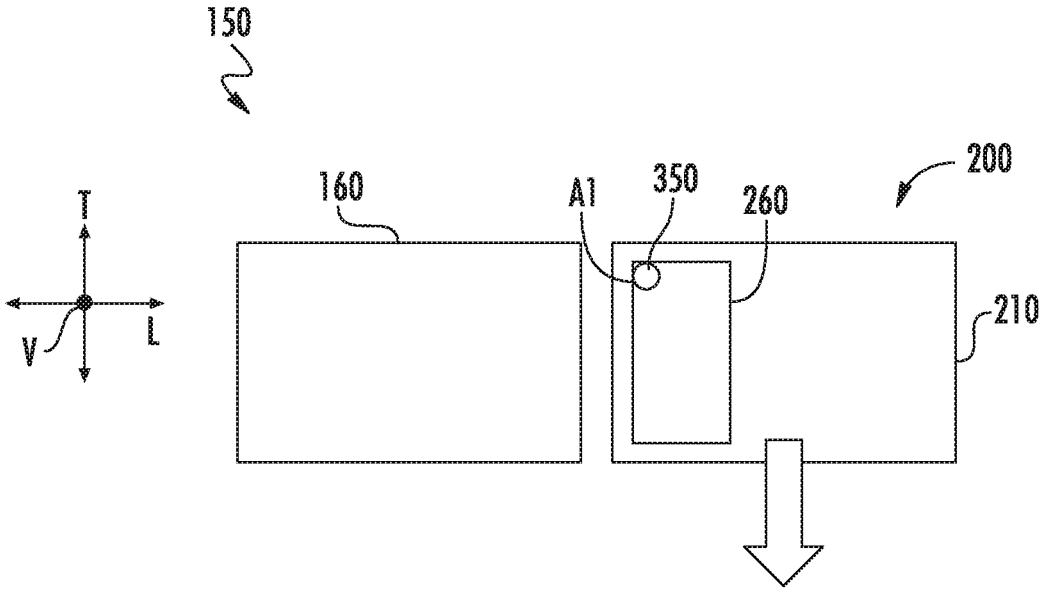
FIG. 12 provides a schematic top view of another exemplary drawer system according to an exemplary embodiment of the present subject.
Figure 13:
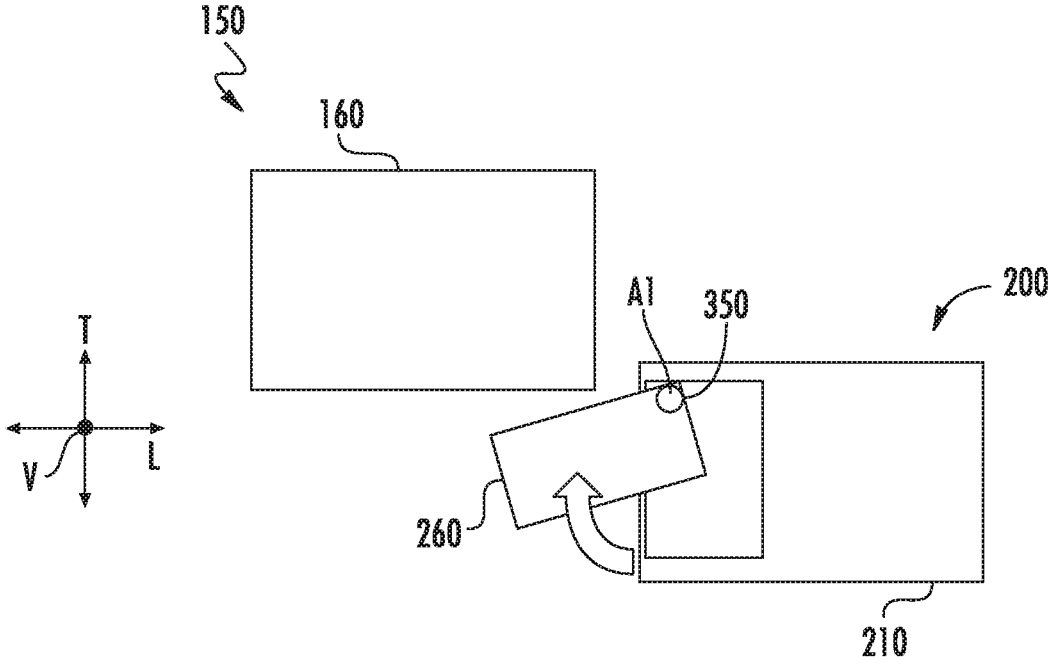
FIG. 13 provides a schematic top view of the drawer system of FIG. 12 depicting one of the drawer assemblies in a withdrawn position and one of the bins of the drawer assembly being rotated from a received position to an expanded position.

FIGS. 12 and 13 provide another exemplary embodiment of drawer system 150 according to an exemplary embodiment of the present subject. In particular, FIG. 12 provides a schematic top view of drawer system 150 depicting drawer assembly 200 in a retracted position and FIG. 13 provides a schematic top view of the drawer system 150 of FIG. 12 depicting drawer assembly 200 in a withdrawn position and a bin, denoted as 260, of drawer assembly 200 being rotated from a received position to an expanded position. As shown in the depicted embodiment of FIGS. 12 and 13, drawer assembly 200 includes only a single bin 260 that is rotatable about the vertical direction V. In this way, the remaining portion of drawer 210 of drawer assembly 200 may be utilized for relatively larger food items. Further, for this embodiment, drawer assembly 200 includes features that automatically move bin 260 from the received position to the expanded position when drawer assembly 200 is moved to the withdrawn position. More particularly, for this embodiment, drawer assembly 200 includes a biasing element 350 positioned along the rotational axis, denoted as A1. As one example, the biasing element 350 may be a torsion spring. When drawer assembly 200 is moved to the withdrawn position, biasing element 350 drives bin 260 to rotate along the rotation axis A1 toward the expanded position. In contrast, when drawer assembly 200 is moved to the retracted position, biasing element 350 allows bin 260 to rotate along the rotation axis A1 toward the received position. For instance, where biasing element 350 is a torsion spring, the tension in the torsion spring may be released to allow bin 260 to rotate along the rotation axis A1 toward the received position. It will be appreciated that in alternative exemplary embodiments that bin 260 of FIGS. 12 and 13 may be moved between the received position and the expanded position by the striker features as shown in FIGS. 3 through 8 and described in the accompanying text or by the geared features as shown in FIGS. 9 through 11 and described in the accompanying text.

In addition, in some exemplary embodiments, one or more bins of a drawer assembly may be rotatable about the vertical direction V between the received position and the expanded position manually. That is, users may rotate one or more of the bins from their respective received positions to their respective expanded positions by pushing, pulling, or otherwise rotating the bins about their respective rotation axes.

Figure 14:
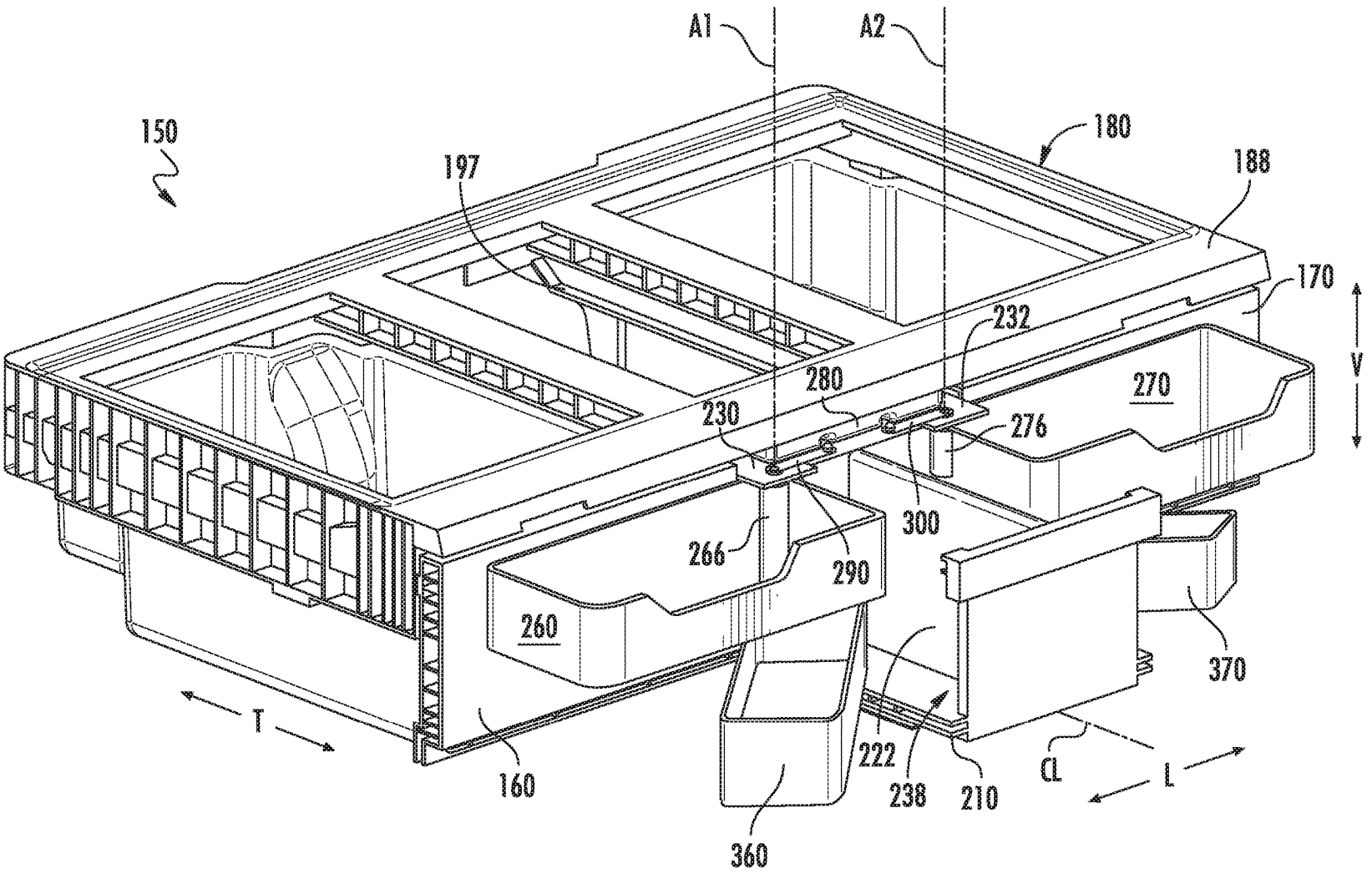
FIG. 14 provides a front perspective view of an exemplary drawer system depicting a drawer assembly in the withdrawn position and upper bins of the drawer assembly each rotated to an expanded position and lower bins of the drawer assembly each rotated to an expanded position according to an exemplary embodiment of the present subject matter.

In some exemplary embodiments, drawer system included stacked bins. For instance, FIG. 14 provides a front perspective view of an exemplary drawer system 150 depicting drawer assembly in the withdrawn position and upper bins 260, 270 each rotated to their respective expanded positions and lower bins 360, 370 of the drawer assembly each rotated to their respective expanded positions as well. Notably, for this embodiment, the upper bins 260, 270 are configured to rotate about ninety degrees (90°) about their respective rotation axes A1, A2, to their fully expanded positions and the lower bins 360, 370 are configured to rotate about forty-five degrees (45°) about their respective rotation axes A1, A2, to their fully expanded positions. In this way, the drawer assembly 150 of FIG. 14 creates a tiered system for accessing food items stored in the bins 260, 270, 360, 370. The tiered drawer system may further facilitate access to and removal of items from bins 260, 270, 360, 370.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An appliance defining a vertical direction, comprising:
- a cabinet defining a chamber;
- a frame extending between a front and a back;
- a guide plate coupled with the frame and positioned at the front of the frame, the guide plate defining a groove;
- a drawer assembly configured to slide between a retracted position and a withdrawn position, the drawer assembly comprising:
  - a drawer slidably received within the chamber in the retracted position and at least partially withdrawn from the chamber in the withdrawn position; and
  - a bin rotatably coupled with the drawer about a rotation axis between a received position and an expanded position, wherein when the bin is in the received position, the bin is received within the drawer and wherein when the bin is in the expanded position, the bin is rotated outward from the drawer about the rotation axis, wherein the bin defines a hinge and the drawer defines an aperture both aligned along the rotation axis;
- a striker having a shaft portion and a striker arm, the shaft portion extending along the rotation axis and received through the aperture of the drawer and within the hinge of the bin, the striker arm projecting from the shaft portion along a direction orthogonal to the vertical direction, and wherein when the drawer assembly is in the withdrawn position, the bin is rotated to the expanded position and wherein when the drawer assembly is in the retracted position, the bin is received within drawer in the received position, and wherein when the drawer assembly is slid from the retracted position to the withdrawn position, the striker arm of the striker is received within the groove and is slid along the groove to drive the bin about the rotation axis to rotate the bin to the expanded position.

2. The appliance of claim 1, wherein when the drawer assembly is slid to the withdrawn position, the bin automatically rotates to the expanded position.

3. The appliance of claim 1, wherein the bin is a first bin and the rotation axis is a first rotation axis, and wherein the drawer assembly further comprises:

a second bin rotatably coupled with the drawer about a second rotation axis, wherein the second bin is rotatable between a received position and an expanded position, and wherein when the second bin is in the received position, the second bin is received within the drawer and wherein when the second bin is in the expanded position, the second bin is rotated outward from the drawer about the second rotation axis.

4. The appliance of claim 3, wherein the appliance defines a transverse direction orthogonal to the vertical direction, and wherein the drawer assembly is configured to slide between the retracted position and the withdrawn position along the transverse direction, and wherein the appliance defines a lateral direction orthogonal to the transverse direction and the vertical direction, and wherein the first bin is spaced from the second bin along the lateral direction.

5. The appliance of claim 3, wherein the first bin rotates about the first rotation axis and the second bin rotates about the second rotation axis in opposite directions when rotating from their respective the received positions to their respective the expanded positions.

6. The appliance of claim 1, wherein when the drawer assembly is slid from the withdrawn position to the retracted position, the striker arm of the striker received within the groove is slid along the groove to drive the bin about the rotation axis to rotate the bin to the received position.

7. The appliance of claim 1, wherein the striker arm has a striker head projecting therefrom along the vertical direction.

8. The appliance of claim 7, wherein the striker head has a spherical shape.

9. The appliance of claim 1, wherein the bin is a lower bin, and wherein the drawer assembly further comprises:

an upper bin stacked on the lower bin and rotatably coupled with the drawer and the lower bin about the rotation axis between a received position and an expanded position, wherein when the upper bin is in the received position, the upper bin is received within the drawer and wherein when the upper bin is in the expanded position, the upper bin is rotated outward from the drawer about the rotation axis.

10. The appliance of claim 9, wherein the upper bin is rotatable ninety degrees(90°) about the rotation axis and the lower bin is rotatable forty-five degrees(45°)about the rotation axis.

11. A refrigerator appliance, comprising:

a cabinet defining a chilled chamber;

a drawer assembly movable between a retracted position and a withdrawn position, the drawer assembly comprising:

a frame coupled with the cabinet;

a drawer movably coupled with the frame and configured to be received within the chilled chamber in the retracted position and at least partially withdrawn from the chilled chamber in the withdrawn position;

a bin rotatably coupled with the drawer about a rotation axis and movable between a received position and an expanded position, wherein when the bin is in the received position, the bin is received within the drawer and wherein when the bin is in the expanded position, the bin is rotated about the rotation axis, wherein the bin defines a hinge aligned along the rotation axis and the drawer defines an aperture aligned along the rotation axis;

a striker having a shaft portion and a striker arm, the shaft portion extending along the rotation axis and received through the aperture of the drawer and within the hinge of the bin, the striker arm projecting from the shaft portion, and wherein when the drawer assembly is moved toward the withdrawn position, the bin is automatically rotated toward the expanded position and wherein when the drawer assembly is moved toward the retracted position, the bin is automatically rotated toward the received position.

12. The refrigerator appliance of claim 11, wherein the refrigerator appliance defines a vertical direction and a direction orthogonal to the vertical direction, and wherein the rotation axis extends along the vertical direction, and wherein the striker arm projects from the shaft portion along the direction orthogonal to the vertical direction and has a striker head projecting therefrom along the vertical direction.

13. The refrigerator appliance of claim 12, further comprising:

a frame extending between a front and a back along the transverse direction and having a front member positioned at the font of the frame;

a guide plate having a top surface and an opposing bottom surface, the guide plate coupled with the front member of the frame, the bottom surface of the guide plate defining a groove, wherein when the drawer assembly is moved from the retracted position to the withdrawn position, the striker head of the striker is received within the groove and is moved along the groove to drive the striker arm about the rotation axis that in turn drives the bin about the rotation axis to rotate the bin toward the expanded position.

14. The refrigerator appliance of claim 11, further comprising:

a biasing element configured to automatically move the bin between the received position and the retracted position.

15. The refrigerator appliance of claim 11, wherein the bin is a lower bin, and wherein the drawer assembly further comprises:

an upper bin stacked on the lower bin and rotatably coupled with the drawer and the lower bin about the rotation axis between a received position and an expanded position, wherein when the upper bin is in the received position, the upper bin is received within the drawer and wherein when the upper bin is in the expanded position, the upper bin is rotated outward from the drawer about the rotation axis.

16. An appliance, comprising:

a cabinet defining a chamber;

a drawer assembly configured to slide between a retracted position and a withdrawn position, the drawer assembly comprising:

a drawer slidably received within the chamber in the retracted position and at least partially withdrawn from the chamber in the withdrawn position;

a bin rotatably coupled with the drawer about a rotation axis between a received position and an expanded position, wherein when the bin is in the received position, the bin is received within the drawer and wherein when the bin is in the expanded position, the bin is rotated outward from the drawer about the rotation axis, and wherein the bin defines a hinge and the drawer defines an aperture both aligned along the rotation axis;

a lead gear having a shaft portion extending along the rotation axis and received through the aperture of the drawer and within the hinge of the bin;

an idler gear in meshing engagement with the lead gear and rotatably coupled with the drawer; and a drive gear in meshing engagement with the idler gear and rotatably coupled with the drawer, and wherein when the drawer assembly is in the withdrawn position, the bin is rotated to the expanded position and wherein when the drawer assembly is in the retracted position, the bin is received within drawer in the received position.

17. The appliance of claim 16, wherein the appliance defines a vertical direction, a lateral direction, and a transverse direction mutually perpendicular to one another, and wherein the appliance further comprises:

a frame extending between a front and a back along the transverse direction;

a track coupled with the frame and having a geared portion, wherein when the drawer assembly is slid from the retracted position to the withdrawn position, the drive gear engages the geared portion of the track in meshing engagement to drive the idler gear that in turn drives the lead gear to drive the bin about the rotation axis to rotate the bin to the expanded position.

18. The appliance of claim 17, wherein when the drawer assembly is slid from the withdrawn position to the retracted position, the drive gear engaged with the geared portion of the rack in meshing engagement drives the idler gear that in turn drives the lead gear to drive the bin about the rotation axis to rotate the bin to the received position.

19. The appliance of claim 17, wherein when the drawer assembly is one of a plurality of drawer assemblies of a drawer system, and wherein the drawer system comprises:

a first side drawer; and a second side drawer spaced from the first side drawer;

wherein the drawer assembly is disposed between the first side drawer and the second side drawer.

20. The appliance of claim 17, wherein the drawer assembly defines a centerline along the lateral direction, and wherein the groove extends between a mouth and a terminal end along the transverse direction, and wherein the terminal end is positioned inward of the mouth along the lateral direction.

* * * * *